US012256773B2

(12) United States Patent
Garcia-Doty

(10) Patent No.: US 12,256,773 B2
(45) Date of Patent: Mar. 25, 2025

(54) VAPORIZABLE MATERIAL INSERT FOR VAPORIZER DEVICE

(71) Applicant: JUUL Labs, Inc., San Francisco, CA (US)

(72) Inventor: Ian Garcia-Doty, Oakland, CA (US)

(73) Assignee: JUUL Labs, Inc., Washington, DC (US)

( * ) Notice: Subject to any disclaimer, the term of this patent is extended or adjusted under 35 U.S.C. 154(b) by 146 days.

(21) Appl. No.: 17/587,451

(22) Filed: Jan. 28, 2022

(65) Prior Publication Data

US 2022/0151285 A1 May 19, 2022

Related U.S. Application Data

(63) Continuation of application No. PCT/US2020/045382, filed on Aug. 7, 2020.

(60) Provisional application No. 62/884,668, filed on Aug. 8, 2019.

(51) Int. Cl.

| | |
|---|---|
| ***A24F 40/42*** | (2020.01) |
| ***A24D 1/20*** | (2020.01) |
| ***A24F 40/20*** | (2020.01) |

(52) U.S. Cl.

CPC ..... *A24D 1/20* (2020.01); *A24F 40/20* (2020.01); *A24F 40/42* (2020.01)

(58) Field of Classification Search

CPC ..... A24D 1/20; A24F 40/42

See application file for complete search history.

(56) References Cited

U.S. PATENT DOCUMENTS

| | | | |
|---|---|---|---|
| 3,373,915 | A | 3/1968 | Anderson et al. |
| 3,559,655 | A | 2/1971 | Briskin et al. |
| 4,708,151 | A | 11/1987 | Shelar |
| 5,042,509 | A | 8/1991 | Banerjee et al. |
| 5,065,776 | A | 11/1991 | Lawson et al. |
| 5,249,586 | A | 10/1993 | Morgan et al. |
| 5,479,948 | A | 1/1996 | Counts et al. |

(Continued)

FOREIGN PATENT DOCUMENTS

| | | | |
|---|---|---|---|
| CA | 3010559 | A1 | 7/2017 |
| CN | 102753047 | A | 10/2012 |

(Continued)

OTHER PUBLICATIONS

PCT/US2020/045382, Aug. 7, 2020, WO 2021/026443.

(Continued)

*Primary Examiner* — Ross N Gushi

(74) *Attorney, Agent, or Firm* — Mintz, Levin, Cohn, Ferris, Glovsky & Popeo, P.C.

(57) ABSTRACT

A vaporization device is describe that includes a vaporizer body including a vaporizable material insert receptacle configured to receive a vaporizable material insert including vaporizable material. The vaporizable material insert can include a vaporizable material component including a vaporizable material, such as a non-liquid vaporizable material. Various embodiments of the vaporizable material component are described that include one or more features for preventing airflow into and/or through the vaporizable material component, as well as for achieving efficient and effective heating of the vaporizable material and formation of inhalable aerosol. Related systems, methods, and articles of manufacture are also described.

20 Claims, 4 Drawing Sheets

(56) References Cited

U.S. PATENT DOCUMENTS

| | | | |
|---|---|---|---|
| 7,726,320 | B2 | 6/2010 | Robinson et al. |
| 8,490,629 | B1 | 7/2013 | Shenassa et al. |
| 8,671,952 | B2 | 3/2014 | Winterson et al. |
| 8,869,792 | B1 | 10/2014 | Lee |
| 8,991,402 | B2 | 3/2015 | Bowen et al. |
| 9,408,416 | B2 | 8/2016 | Monsees et al. |
| 9,943,114 | B2 | 4/2018 | Batista |
| 10,729,179 | B2 | 8/2020 | Atkins et al. |
| 11,129,414 | B2 | 9/2021 | Atkins et al. |
| 11,147,128 | B2 | 10/2021 | Qiu |
| 11,464,082 | B2 | 10/2022 | Jobanputra et al. |
| 2004/0055613 | A1 | 3/2004 | Horian |
| 2005/0268911 | A1 | 12/2005 | Cross et al. |
| 2006/0032501 | A1 | 2/2006 | Hale et al. |
| 2007/0221234 | A1 | 9/2007 | Beckstead |
| 2007/0283972 | A1 | 12/2007 | Monsees et al. |
| 2008/0092912 | A1 | 4/2008 | Robinson et al. |
| 2009/0126746 | A1 | 5/2009 | Strickland et al. |
| 2009/0151717 | A1 | 6/2009 | Bowen et al. |
| 2009/0260642 | A1 | 10/2009 | Monsees et al. |
| 2010/0024834 | A1 | 2/2010 | Oglesby et al. |
| 2011/0041861 | A1 | 2/2011 | Sebastian et al. |
| 2011/0226236 | A1 | 9/2011 | Buchberger |
| 2011/0290267 | A1 | 12/2011 | Yamada et al. |
| 2013/0042865 | A1 | 2/2013 | Monsees et al. |
| 2014/0301721 | A1 | 10/2014 | Ruscio et al. |
| 2014/0366898 | A1 | 12/2014 | Monsees et al. |
| 2015/0272218 | A1 | 10/2015 | Chen |
| 2015/0335070 | A1 | 11/2015 | Sears et al. |
| 2016/0073692 | A1 | 3/2016 | Alarcon et al. |
| 2016/0120225 | A1 | 5/2016 | Mishra et al. |
| 2016/0120227 | A1 | 5/2016 | Levitz et al. |
| 2016/0295922 | A1 | 10/2016 | John et al. |
| 2016/0309782 | A1 | 10/2016 | Malgat et al. |
| 2016/0338412 | A1 | 11/2016 | Monsees et al. |
| 2017/0055575 | A1 | 3/2017 | Wilke et al. |
| 2017/0055580 | A1 | 3/2017 | Blandino et al. |
| 2017/0071250 | A1 | 3/2017 | Mironov et al. |
| 2017/0143041 | A1 | 5/2017 | Batista et al. |
| 2017/0156403 | A1 | 6/2017 | Gill et al. |
| 2017/0164657 | A1 | 6/2017 | Batista |
| 2018/0027877 | A1 | 2/2018 | Tucker et al. |
| 2018/0027883 | A1 | 2/2018 | Zuber et al. |
| 2018/0084823 | A1 | 3/2018 | Fuisz et al. |
| 2018/0110263 | A1 | 4/2018 | Borkovec et al. |
| 2018/0132534 | A1 | 5/2018 | Reevell |
| 2018/0228216 | A1 | 8/2018 | Saygili |
| 2018/0295881 | A1 | 10/2018 | Mironov et al. |
| 2018/0325179 | A1 | 11/2018 | Li et al. |
| 2019/0001077 | A1 | 1/2019 | Xu et al. |
| 2019/0037921 | A1 | 2/2019 | Kennedy et al. |
| 2019/0098930 | A1 | 4/2019 | Fallon et al. |
| 2019/0124982 | A1 | 5/2019 | Atkins et al. |
| 2019/0166913 | A1 | 6/2019 | Trzecieski |
| 2019/0191769 | A1 | 6/2019 | Qiu |
| 2019/0200674 | A1 | 7/2019 | Tucker et al. |
| 2019/0208827 | A1 | 7/2019 | Mironov et al. |
| 2020/0107585 | A1 | 4/2020 | Atkins et al. |
| 2020/0113245 | A1 | 4/2020 | Rosser et al. |
| 2020/0120993 | A1 | 4/2020 | Atkins et al. |
| 2021/0186113 | A1 | 6/2021 | Lee |
| 2021/0321672 | A1 | 10/2021 | Wilke et al. |
| 2021/0386120 | A1 | 12/2021 | Gill |
| 2022/0046997 | A1 | 2/2022 | Atkins et al. |
| 2022/0095685 | A1 | 3/2022 | Atkins et al. |
| 2022/0104550 | A1 | 4/2022 | Mao et al. |
| 2022/0151285 | A1 | 5/2022 | Garcia-Doty |
| 2022/0160040 | A1 | 5/2022 | Zhang et al. |
| 2023/0309615 | A1 | 10/2023 | Mauchle et al. |

FOREIGN PATENT DOCUMENTS

| | | | |
|---|---|---|---|
| CN | 103783674 | A | 5/2014 |
| CN | 105764367 | A | 7/2016 |
| CN | 106307622 | A | 1/2017 |
| CN | 106572705 | A | 4/2017 |
| CN | 106659247 | A | 5/2017 |
| CN | 106659250 | A | 5/2017 |
| CN | 106858726 | A | 6/2017 |
| CN | 107772540 | A | 3/2018 |
| CN | 111432670 | A | 7/2020 |
| CN | 113163855 | A | 7/2021 |
| EP | 2394520 | A1 | 12/2011 |
| EP | 3420829 | A1 | 1/2019 |
| EP | 3664631 | A2 | 6/2020 |
| EP | 3795009 | A1 | 3/2021 |
| GB | 2527597 | A | 12/2015 |
| GB | 2547699 | A | 8/2017 |
| GB | 2568411 | B | 8/2019 |
| JP | S5138499 | A | 3/1976 |
| JP | 2001-507576 | A | 6/2001 |
| JP | 2016538847 | A | 12/2006 |
| JP | 2010506594 | A | 3/2010 |
| JP | 2010517568 | A | 5/2010 |
| JP | 2010178730 | A | 8/2010 |
| JP | 2015-509709 | A | 4/2015 |
| JP | 2016538850 | A | 12/2016 |
| JP | 2017018146 | A | 1/2017 |
| JP | 2017-529896 | A | 10/2017 |
| JP | 2017529848 | A | 10/2017 |
| JP | 2017533732 | A | 11/2017 |
| JP | 2020536536 | A | 12/2020 |
| KR | 20-2012-0008751 | U | 12/2012 |
| KR | 10-2016-0112769 | A | 9/2016 |
| KR | 10-2021-0155091 | A | 12/2021 |
| RU | 2602053 | C2 | 11/2016 |
| RU | 2604313 | C2 | 12/2016 |
| RU | 2629878 | C1 | 9/2017 |
| RU | 2655239 | C2 | 5/2018 |
| WO | WO-2006120570 | A2 | 11/2006 |
| WO | WO-2011079932 | A1 | 7/2011 |
| WO | WO-2015082651 | A1 | 6/2015 |
| WO | WO-2015179388 | A1 | 11/2015 |
| WO | WO-2016005533 | A1 | 1/2016 |
| WO | WO-2016062777 | A1 | 4/2016 |
| WO | WO-2016079589 | A1 | 5/2016 |
| WO | WO-2016162446 | A1 | 10/2016 |
| WO | WO-2017072148 | A1 | 5/2017 |
| WO | WO-2017122196 | A1 | 7/2017 |
| WO | WO-2017129617 | A1 | 8/2017 |
| WO | WO-2017207418 | A1 | 12/2017 |
| WO | WO-2017207419 | A1 | 12/2017 |
| WO | WO-2017207582 | A1 | 12/2017 |
| WO | WO-2018019578 | A1 | 2/2018 |
| WO | WO-2018041065 | A1 | 3/2018 |
| WO | WO-2018122389 | A1 | 7/2018 |
| WO | WO-2018122978 | A1 | 7/2018 |
| WO | WO-2018206615 | A2 | 11/2018 |
| WO | WO-2019057942 | A1 | 3/2019 |
| WO | WO-2019073237 | A1 | 4/2019 |
| WO | WO-2019122015 | A1 | 6/2019 |
| WO | WO-2020028591 | A1 | 2/2020 |
| WO | WO-2020239599 | A1 | 12/2020 |

OTHER PUBLICATIONS

Guo, et al. (Mar. 31, 2016) "Heat Transfer Performance of Atomizer of Electronic Cigar", Popular Science and Technology, 18(3):52-54.

U.S. Appl. No. 18/762,100, filed Jul. 2, 2024.

(2015) "Property Tables and Charts (SI Units0", Wright State University, pp. 865-892.

VAPORIZABLE MATERIAL INSERT FOR VAPORIZER DEVICE

CROSS-REFERENCE TO RELATED APPLICATION

This application is a bypass continuation and claims priority to PCT/US2020/045382, filed on Aug. 7, 2020 and entitled "VAPORIZABLE MATERIAL INSERT FOR VAPORIZER DEVICE," which claims priority under 35 U.S.C. § 119(a) to U.S. Provisional application Ser. No. 62/884,668, filed on Aug. 8, 2019 and entitled "VAPORIZABLE MATERIAL INSERT FOR VAPORIZER DEVICE," disclosures of which [is] are incorporated by reference herein in [its] their entirety.

TECHNICAL FIELD

The subject matter described herein relates to various embodiments of a vaporizable material insert for use with a vaporizer device.

BACKGROUND

Vaporizer devices, which can also be referred to as vaporizers, electronic vaporizer devices, or e-vaporizer devices, can be used for delivery of an aerosol (for example, a vapor-phase and/or condensed-phase material suspended in a stationary or moving mass of air or some other gas carrier) containing one or more active ingredients by inhalation of the aerosol by a user of the vaporizing device. For example, electronic nicotine delivery systems (ENDS) include a class of vaporizer devices that are battery powered and that can be used to simulate the experience of smoking. Vaporizers are gaining increasing popularity both for prescriptive medical use, in delivering medicaments, and for consumption of tobacco, nicotine, and other plant-based materials. Vaporizer devices can be portable, self-contained, and/or convenient for use.

In use of a vaporizer device, the user inhales an aerosol, colloquially referred to as "vapor," which can be generated by a heating element that vaporizes a vaporizable material, for example, by causing the vaporizable material to transition at least partially to a gas phase. The vaporizable material may be a liquid, a solution, a solid, a paste, a wax, and/or any other form compatible for use with a specific vaporizer device. Moreover, the vaporizable material used with a vaporizer can be provided within a vaporizer cartridge, which may be a separable part of the vaporizer device that contains the vaporizable material and having an outlet (e.g., a mouthpiece) for delivering the aerosol generated by the vaporization of the vaporizable material to a user.

To receive the inhalable aerosol generated by a vaporizer device, a user may, in certain examples, activate the vaporizer device by taking a puff, by pressing a button, and/or by some other approach. A puff as used herein can refer to inhalation by the user in a manner that causes a volume of air to be drawn into the vaporizer device such that the inhalable aerosol is generated when the vaporized vaporizable material is combined with the volume of air.

An approach by which a vaporizer device generates an inhalable aerosol from a vaporizable material involves heating the vaporizable material in a vaporization chamber (e.g., a heater chamber) to cause the vaporizable material to be converted to the gas (or vapor) phase. A vaporization chamber can refer to an area or volume in the vaporizer device within which a heat source (for example, a conductive, convective, and/or radiative heat source) causes heating of a vaporizable material to produce a mixture of air and vaporized material to form a vapor for inhalation of the vaporizable material by a user of the vaporization device.

In some embodiments, vaporizer cartridges configured to heat solid vaporizable material (e.g. plant material such as tobacco leaves and/or parts of tobacco leaves) can require higher temperatures for inner tobacco regions to reach a minimum required temperature for vaporization. As a result, burning the solid vaporizable material at these high peak temperatures can produce undesirable byproducts (e.g., chemical elements or chemical compounds).

Vaporizer devices can be categorized into two classes, those that heat through conduction and those that heat through convection. For example, conduction-based vaporizer devices may be configured to vaporize liquid vaporizable material using a heating element contacting the liquid vaporizable material. As such, the liquid vaporizable material may contaminate the heating element, which can compromise performance of the vaporizer device. Some vaporizers may incorporate the heating element into the disposable part of the vaporizer device (e.g., the cartridge), such that the heating element may be replaced with each new cartridge and thereby limit, but not eliminate, heating element contamination. However, this can increase manufacturing labor and costs associated with the disposable. Furthermore, uniform heating of the vaporizable material in current conduction-based vaporizers may be difficult to achieve due to the low thermal conductivity of certain vaporizable materials (e.g., plant materials, such as tobacco).

Some vaporizable materials include plant materials, such as tobacco, and may have low thermal conductivity and thus be difficult to evenly heat. Additionally, such vaporizable material may include numerous air gaps that limit heat from fully penetrating through the vaporizable material. As a result, current vaporizer devices may try to overcome such heating difficulties by overheating the vaporizable material near the heater and underheating the vaporizable material further from the heater. Such uneven heating may result in unsatisfactory vapor production, unpleasant odors from the overheated tobacco, and/or an increased release of harmful or potentially harmful chemicals.

Other vaporizer devices may include a heating element in the reusable or durable portion of the vaporizer device, such that the heating element is configured to be reused for the life of the vaporizer device. However, the heater in such vaporizer devices can often fail and require cleaning.

SUMMARY

Aspects of the current subject matter relate to a system for generating an inhalable aerosol. The system may include a vaporizable material insert for use with a vaporizer device to form an inhalable aerosol.

In one aspect, the vaporizable material insert may include a housing including an inlet and an outlet and a vaporizable material component. The vaporizable material component may include a vaporizable material for forming a part of the inhalable aerosol as a result of heating the vaporizable material component. The vaporizable material component may extend within the housing between the inlet and outlet. The vaporizable material component may further include an airflow pathway that extends along the vaporizable material component and may be at least partly defined by a wall of the vaporizable material component. The wall of the vaporizable material component can prevent air traveling along the airflow pathway from traveling into the vaporizable material component. Additionally, the wall can allow the inhalable aerosol to form in the airflow pathway and travel through the outlet for inhalation by a user.

In some variations one or more of the following features can optionally be included in any feasible combination. In some embodiments, the airflow pathway may extend through the vaporizable material component such that the wall defines the airflow pathway. In some embodiments, the vaporizable material insert may further include a heating element extending along the vaporizable material component. The vaporizable material component may be positioned between the heating element and the airflow pathway. In some embodiments, the heating element may extend through and along a longitudinal axis of the vaporizable material component.

In some embodiments, the vaporizable material component may include a cylindrical shape. In some embodiments, the vaporizable material component may include a flat shape. The vaporizable material component may be formed of the vaporizable material and a guar gum material. The vaporizable material component may be formed of the vaporizable material and a laponite material. The vaporizable material may include a tobacco material. The tobacco material may include a tobacco powder. The housing may be formed of a paper material. The housing may include a heating element configured to heat the vaporizable material component. The vaporizable material component may include thermally conductive particles that directly contact the vaporizable material and are contained within the vaporizable material component. The thermally conductive particles may be formed of a metal material. In some embodiments, a thermal conductivity of the vaporizable material component may include a range from approximately 0.2 W/mK to approximately 0.6 W/mK.

In another aspect, a system for generating the inhalable aerosol may include a vaporizable material insert and a vaporizer device. The vaporizable material insert may include a housing including an inlet and an outlet and a vaporizable material component. The vaporizable material component may include a vaporizable material for forming a part of the inhalable aerosol as a result of heating the vaporizable material component. The vaporizable material component may extend within the housing between the inlet and outlet. The vaporizable material component may further include an airflow pathway that extends along the vaporizable material component and may be at least partly defined by a wall of the vaporizable material component. The wall of the vaporizable material component can prevent air traveling along the airflow pathway from traveling into the vaporizable material component Additionally, the wall can allow the inhalable aerosol to form in the airflow pathway and travel through the outlet for inhalation by a user.

In some embodiments of the system, the vaporizer device may include a vaporizable material insert receptacle configured to receive the vaporizable material insert. The vaporizer device may also include a power supply for providing power to a heating element for heating the vaporizable material insert and forming the inhalable aerosol.

In some variations one or more of the following features can optionally be included in any feasible combination. In some embodiments, the vaporizer device may include the heating element. In some embodiments, the vaporizable material insert may include the heating element. The vaporizable material insert receptacle can provide a sliding fit with the vaporizable material insert. The vaporizable material component may be formed of the vaporizable material and a guar gum material. The vaporizable material component may be formed of the vaporizable material and a laponite material. The vaporizable material may include a tobacco material. The tobacco material may include a tobacco powder.

In another interrelated aspect of the current subject matter, a method includes receiving a vaporizable material insert into a compartment of a vaporizer device. In some embodiments, the vaporizable material insert may include a housing including an inlet and an outlet and a vaporizable material component. The vaporizable material component may include a vaporizable material for forming a part of the inhalable aerosol as a result of heating the vaporizable material component. The vaporizable material component may extend within the housing between the inlet and outlet. The vaporizable material component may further include an airflow pathway that extends along the vaporizable material component and may be at least partly defined by a wall of the vaporizable material component. The wall of the vaporizable material component can prevent air traveling along the airflow pathway from traveling into the vaporizable material component Additionally, the wall can allow the inhalable aerosol to form in the airflow pathway and travel through the outlet for inhalation by a user. The method may further include activating a heating element configured to heat the vaporizable material component of the vaporizable material insert and forming, as a result of the heated vaporizable material component, the inhalable aerosol.

The details of one or more variations of the subject matter described herein are set forth in the accompanying drawings and the description below. Other features and advantages of the subject matter described herein will be apparent from the description and drawings, and from the claims. The claims that follow this disclosure are intended to define the scope of the protected subject matter.

BRIEF DESCRIPTION OF THE DRAWINGS

The accompanying drawings, which are incorporated in and constitute a part of this specification, show certain aspects of the subject matter disclosed herein and, together with the description, help explain some of the principles associated with the disclosed implementations. In the drawings.

When practical, similar reference numbers denote similar structures, features, or elements.

DETAILED DESCRIPTION

Figure 1:
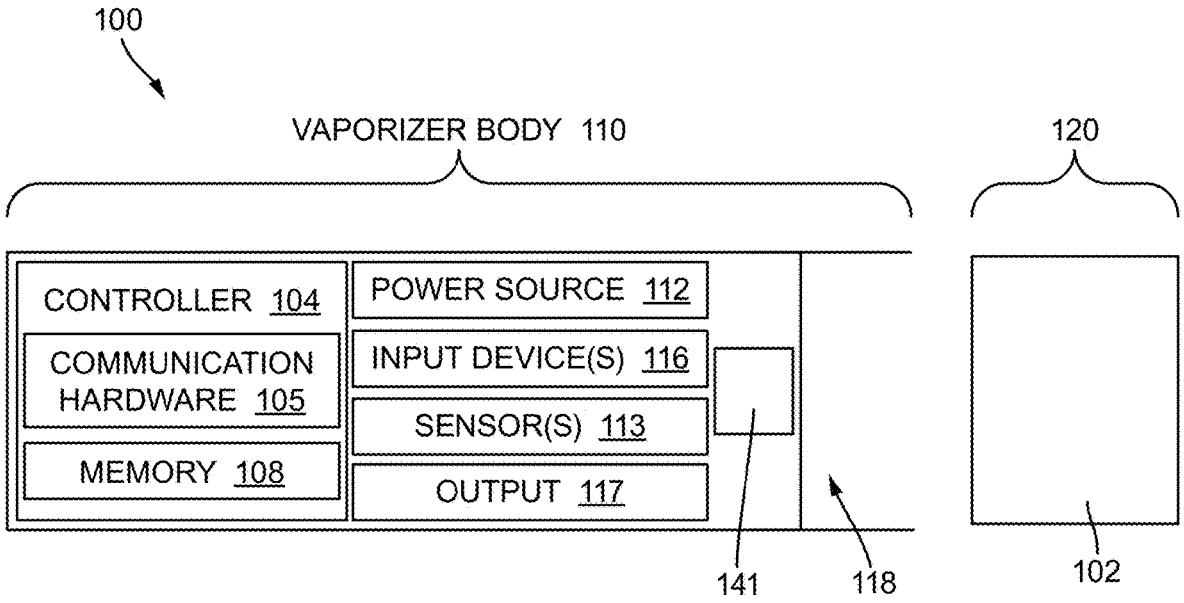
FIG. 1 depicts a block diagram illustrating an example of a vaporizer device, consistent with implementations of the current subject matter.

Implementations of the current subject matter include devices and methods relating to vaporizing one or more vaporizable materials for inhalation by a user. For example, various embodiments of a vaporizable material insert for use with a vaporizer device are described herein. In some embodiments, the vaporizable material insert includes a vaporizable material component formed out of one or more materials, including a vaporizable material. The vaporizable material component can be configured to prevent airflow through the vaporizable material component and achieve efficient and effective thermal conductivity. For example, the vaporizable material component can be void of or include a minimal amount of pockets of air thereby allowing the vaporizable material component to efficiently and effectively heat the vaporizable material of the vaporizable material component.

In some embodiments, the vaporizable material insert can be configured such that the vaporizable material component can be placed in direct contact with and/or in close proximity to a heating element to allow for efficient and effective heat transfer from the heating element to the vaporizable material component. As such, the vaporizable material inserts described herein can be more efficiently heated compared to some currently available vaporizable material inserts, as well as require comparably less power to heat and vaporize the vaporizable material. Other benefits are described herein and are within the scope of this disclosure. Various embodiments of the vaporizable material insert having a vaporizable material component, as well as vaporizer device embodiments configured for heating the vaporizable material inserts, are described in greater detail below.

The term "vaporizer device" as used in the following description and claims refers to any of a self-contained apparatus, an apparatus that includes two or more separable parts (for example, a vaporizer body that includes a battery and other hardware, and a cartridge or insert that includes a vaporizable material), and/or the like. A "vaporizer system," as used herein, can include one or more components, such as a vaporizer device. Examples of vaporizer devices consistent with implementations of the current subject matter include electronic vaporizers, electronic nicotine delivery systems (ENDS), and/or the like. In general, such vaporizer devices are hand-held devices that heat (such as by convection, conduction, radiation, and/or some combination thereof) a vaporizable material to provide an inhalable dose of the material.

The vaporizable material used with a vaporizer may optionally be provided within a vaporizable material insert or cartridge (e.g., a part of the vaporizer that contains the vaporizable material) which can be refillable when empty, or disposable such that a new cartridge containing additional vaporizable material of a same or different type can be used. A vaporizer device can be a cartridge-using vaporizer device, a cartridge-less vaporizer device, or a multi-use vaporizer device capable of use with or without a cartridge. Some cartridge embodiments can include a vaporizable material insert. For example, embodiments of vaporizable material inserts can be at least partly made of a non-liquid vaporizable material. As such, some embodiments of the vaporizer device can be configured to receive a vaporizable material insert that is at least partly made of one or more vaporizable materials for heating and forming an inhalable aerosol, as will be described in greater detail below. In some embodiments, a vaporizer device can include a heating chamber or compartment (e.g., a vaporizable material insert receptacle) configured to receive a vaporizable material insert directly therein and heat the vaporizable material insert for forming an inhalable aerosol.

In some implementations, a vaporizer device can be configured for use with a liquid vaporizable material (for example, a carrier solution in which an active and/or inactive ingredient(s) are suspended or held in solution, or a liquid form of the vaporizable material itself) and/or a non-liquid vaporizable material (e.g., a paste, a wax, a gel, a solid, a plant material, and/or the like). A non-liquid vaporizable material can include a plant material that emits some part of the plant material as the vaporizable material (for example, some part of the plant material remains as waste after the material is vaporized for inhalation by a user) or optionally can be a solid form of the vaporizable material itself, such that all of the solid material can eventually be vaporized for inhalation. A liquid vaporizable material can likewise be capable of being completely vaporized, or can include some portion of the liquid material that remains after all of the material suitable for inhalation has been vaporized.

FIG. 1 depicts a block diagram illustrating an example of a vaporizer device 100 consistent with implementations of the current subject matter. Referring to FIG. 1, the vaporizer device 100 can include a power source 112 (for example, a battery, which can be a rechargeable battery), and a controller 104 (for example, a processor, circuitry, etc. capable of executing logic) for controlling delivery of heat from a heating element 141 to cause a vaporizable material 102 of a vaporizable material insert 120 to be converted from a condensed form (such as a solid, a liquid, a solution, a suspension, a part of an at least partially unprocessed plant material, etc.) to the gas phase. The controller 104 can be part of one or more printed circuit boards (PCBs) consistent with certain implementations of the current subject matter.

After conversion of the vaporizable material 102 to the gas phase, at least some of the vaporizable material 102 in the gas phase can condense to form particulate matter in at least a partial local equilibrium with the gas phase as part of an aerosol, which can form some or all of an inhalable dose provided by the vaporizer device 100 during a user's puff or draw on the vaporizer device 100. It should be appreciated that the interplay between gas and condensed phases in an aerosol generated by a vaporizer device 100 can be complex and dynamic, due to factors such as ambient temperature, relative humidity, chemistry, flow conditions in airflow paths (both inside the vaporizer and in the airways of a human or other animal), and/or mixing of the vaporizable material 102 in the gas phase or in the aerosol phase with other air streams, which can affect one or more physical parameters of an aerosol. In some vaporizer devices, and particularly for vaporizer devices configured for delivery of volatile vaporizable materials, the inhalable dose can exist predominantly in the gas phase (for example, formation of condensed phase particles can be very limited).

The heating element 141 can include one or more of a conductive heater, a radiative heater, and/or a convective heater. One type of heating element is a resistive heating element, which can include a material (such as a metal or alloy, for example a nickel-chromium alloy, or a non-metallic resistor) configured to dissipate electrical power in the form of heat when electrical current is passed through one or more resistive segments of the heating element. In some implementations of the current subject matter, the heating element 141 (e.g., a resistive heating element and/or the like) is configured to generate heat for vaporizing the vaporizable material 102 to generate an inhalable dose of the vaporizable material 102. As noted, the vaporizable material 102 may be a liquid or non-liquid (or combination of both liquid and non-liquid). For example, the heating element 141 may be wrapped around, positioned within, integrated into a bulk shape of, pressed into thermal contact with, or otherwise arranged to deliver heat to the vaporizable material 102 to be vaporized for subsequent inhalation by a user in a gas and/or a condensed (for example, aerosol particles or droplets) phase.

In some embodiments, the vaporizable material 102 may be a non-liquid vaporizable material including, for example, a solid-phase material (such as a gel, a wax, or the like) or plant material (e.g., tobacco leaves and/or parts of tobacco leaves). Where the vaporizable material 102 is a non-liquid vaporizable material, the heating element 141 can be part of, or otherwise incorporated into or in thermal contact with, the walls of a heating chamber or compartment (e.g., vaporizable material insert receptacle 118) into which the vaporizable material insert 120 is placed. Alternatively, the heating element 141 can be used to heat air passing through or past the vaporizable material insert 120, to cause convective heating of the vaporizable material 102 of the vaporizable material insert 120. In still other examples, the heating element 141 can be disposed in intimate contact with the vaporizable material 102 such that direct conductive heating of the vaporizable material 102 of the vaporizable material insert 120 occurs from within a mass of the vaporizable material 102, as opposed to only by conduction inward from walls of the heating chamber (e.g., an oven and/or the like). In some embodiments, the heating element 141 can be a part of the vaporizer body 110 (e.g., part of the durable or reusable part of the vaporizer 100), as shown in FIG. 1. In some embodiments, the heating element 141 can be a part of the vaporizable material insert 120 (e.g., part of the disposable part of the vaporizer 100). For example, the vaporizable material insert 120 can include one or more vaporizable material contacts that mate with one or more vaporizer body contacts (e.g., positioned along the vaporizable material insert receptacle 118) for providing an electrical conductive pathway between the power source 112 of the vaporizer body 110 and the heating element 141 of the vaporizer material insert 120.

The heating element 141 can be activated in association with a user puffing (e.g., drawing, inhaling, etc.) on an end and/or mouthpiece of the vaporizer device 100 to cause air to flow from an air inlet, along an airflow path for assisting with forming an inhalable aerosol that can be delivered out through an air outlet in the mouthpiece. Incoming air moving along the airflow path moves over or through the heating element 141 and/or vaporizable material 102 where vaporizable material 102 in the gas phase is entrained into the air. The heating element 141 can be activated via the controller 104, which can optionally be a part of the vaporizer body 110 as discussed herein, causing current to pass from the power source 112 through a circuit including the heating element 141, which can be part of the vaporizer body 110. As noted herein, the entrained vaporizable material 102 in the gas phase can condense as it passes through the remainder of the airflow path such that an inhalable dose of the vaporizable material 102 in an aerosol form can be delivered from the air outlet (for example, the mouthpiece) for inhalation by a user.

Activation of the heating element 141 can be caused by automatic detection of a puff based on one or more signals generated by one or more sensor(s) 113. The sensor 113 and the signals generated by the sensor 113 can include one or more of: a pressure sensor or sensors disposed to detect pressure along the airflow path relative to ambient pressure (or optionally to measure changes in absolute pressure), a motion sensor or sensors (for example, an accelerometer) of the vaporizer device 100, a flow sensor or sensors of the vaporizer device 100, a capacitive lip sensor of the vaporizer device 100, detection of interaction of a user with the vaporizer device 100 via one or more input devices 116 (for example, buttons or other tactile control devices of the vaporizer device 100), receipt of signals from a computing device in communication with the vaporizer device 100, and/or via other approaches for determining that a puff is occurring or imminent.

As discussed herein, the vaporizer device 100 consistent with implementations of the current subject matter can be configured to connect (such as, for example, wirelessly or via a wired connection) to a computing device (or optionally two or more devices) in communication with the vaporizer device 100. To this end, the controller 104 can include communication hardware 105. The controller 104 can also include a memory 108. The communication hardware 105 can include firmware and/or can be controlled by software for executing one or more cryptographic protocols for the communication.

A computing device can be a component of a vaporizer system that also includes the vaporizer device 100, and can include its own hardware for communication, which can establish a wireless communication channel with the communication hardware 105 of the vaporizer device 100. For example, a computing device used as part of a vaporizer system can include a general-purpose computing device (such as a smartphone, a tablet, a personal computer, some other portable device such as a smartwatch, or the like) that executes software to produce a user interface for enabling a user to interact with the vaporizer device 100. In other implementations of the current subject matter, such a device used as part of a vaporizer system can be a dedicated piece of hardware such as a remote control or other wireless or wired device having one or more physical or soft (e.g., configurable on a screen or other display device and selectable via user interaction with a touch-sensitive screen or some other input device like a mouse, pointer, trackball, cursor buttons, or the like) interface controls. The vaporizer device 100 can also include one or more outputs 117 or devices for providing information to the user. For example, the outputs 117 can include one or more light emitting diodes (LEDs) configured to provide feedback to a user based on a status and/or mode of operation of the vaporizer device 100.

In the example in which a computing device provides signals related to activation of the heating element, or in other examples of coupling of a computing device with the vaporizer device 100 for implementation of various control or other functions, the computing device executes one or more computer instruction sets to provide a user interface and underlying data handling. In one example, detection by the computing device of user interaction with one or more user interface elements can cause the computing device to signal the vaporizer device 100 to activate the heating element to reach an operating temperature for creation of an inhalable dose of vapor/aerosol. Other functions of the vaporizer device 100 can be controlled by interaction of a user with a user interface on a computing device in communication with the vaporizer device 100.

The temperature of the heating element 141 of the vaporizer device 100 can depend on a number of factors, including an amount of electrical power delivered to the heating element 141 and/or a duty cycle at which the electrical power is delivered, conductive heat transfer to other parts of the vaporizer device 100 and/or to the environment, latent heat losses due to vaporization of the vaporizable material 102, and convective heat losses due to airflow (e.g., air moving across the heating element 141 when a user inhales on the vaporizer device 100). As noted herein, to reliably activate the heating element 141 or heat the heating element 141 to a desired temperature, the vaporizer device 100 may, in some implementations of the current subject matter, make use of signals from the sensor 113 (for example, a pressure sensor) to determine when a user is inhaling. The sensor 113 can be positioned in the airflow path and/or can be connected (for example, by a passageway or other path) to an airflow path containing an inlet for air to enter the vaporizer device 100 and an outlet via which the user inhales the resulting vapor and/or aerosol such that the sensor 113 experiences changes (for example, pressure changes) concurrently with air passing through the vaporizer device 100 from the air inlet to the air outlet. In some implementations of the current subject matter, the heating element 141 can be activated in association with a user's puff, for example by automatic detection of the puff, or by the sensor 113 detecting a change (such as a pressure change) in the airflow path.

The sensor 113 can be positioned on or coupled to (e.g., electrically or electronically connected, either physically or via a wireless connection) the controller 104 (for example, a printed circuit board assembly or other type of circuit board). To take measurements accurately and maintain durability of the vaporizer device 100, it can be beneficial to provide a seal resilient enough to separate an airflow path from other parts of the vaporizer device 100. The seal, which can be a gasket, can be configured to at least partially surround the sensor 113 such that connections of the sensor 113 to the internal circuitry of the vaporizer device 100 are separated from a part of the sensor 113 exposed to the airflow path. Such arrangements of the seal in the vaporizer device 100 can be helpful in mitigating against potentially disruptive impacts on vaporizer components resulting from interactions with environmental factors such as water in the vapor or liquid phases and/or to reduce the escape of air from the designated airflow path in the vaporizer device 100. Unwanted air, liquid or other fluid passing and/or contacting circuitry of the vaporizer device 100 can cause various unwanted effects, such as altered pressure readings, and/or can result in the buildup of unwanted material, such as moisture, errant portions of the vaporizable material 102, etc., in parts of the vaporizer device 100 where they can result in poor pressure signal, degradation of the sensor 113 or other components, and/or a shorter life of the vaporizer device 100. Leaks in the seal can also result in a user inhaling air that has passed over parts of the vaporizer device 100 containing, or constructed of, materials that may not be desirable to be inhaled.

In vaporizers in which the power source 112 is part of a vaporizer body 110 and the heating element 141 is disposed in the vaporizable material insert 120 configured to couple with the vaporizer body 110, the vaporizable material insert 120 and vaporizer 100 may include electrical connection features (e.g., electrical contacts) for completing a circuit that includes the controller 104 (e.g., a printed circuit board, a microcontroller, or the like), the power source 112, and the heating element 141. The circuit completed by these electrical connections can allow delivery of electrical current to the heating element 141 (e.g., resistive heating element) and may further be used for additional functions, such as measuring a resistance of the resistive heating element for use in determining and/or controlling a temperature of the resistive heating element based on a thermal coefficient of resistivity of the resistive heating element.

In some embodiments, the vaporizable material insert receptacle 118 can include all or part of the heating element 141 (e.g., a heating coil, resistive heating element, etc.) that is configured to heat the vaporizable material insert 120 received in the vaporizable material insert receptacle 118, such as for forming the inhalable aerosol. For example, the vaporizable material insert receptacle 118 can include a metal sheath and a resistive heater configured to receive the vaporizable material inset 120. Various embodiments of the vaporizable material insert 120 are described herein for use with a variety of vaporizer bodies 110 and vaporizable material insert receptacles 118 for forming inhalable aerosol.

In some implementations, the vaporizable material insert 120 can be configured for insertion in the vaporizable material insert receptacle 118, such as forming a sliding fit between an outer surface of the vaporizable material insert 120 and one or more inner walls of the vaporizable material insert receptacle 118. For example, the vaporizable material insert 120 can have the same or similar shape as the vaporizable material insert receptacle 118. In some embodiments, the vaporizable material insert 120 can include a circular cross-section and/or cylindrical shape. In some embodiments, the vaporizable material insert 120 can have a non-circular cross section transverse to the axis along which the vaporizable material insert 120 is inserted into the vaporizable material insert receptacle 118. For example, the non-circular cross section can be approximately rectangular, approximately elliptical (e.g., have an approximately oval shape), non-rectangular but with two sets of parallel or approximately parallel opposing sides (e.g., having a parallelogram-like shape), or other shapes having rotational symmetry of at least order two. In this context, approximate shape indicates that a basic likeness to the described shape is apparent, but that sides of the shape in question need not be completely linear and vertices need not be completely sharp. Rounding of both or either of the edges or the vertices of the cross-sectional shape is contemplated in the description of any non-circular cross section referred to herein.

In some implementations, at least one of the one or more inner walls forming the vaporizable material insert receptacle 118 can include the heating element 141 and/or include thermally conductive material. For example, vaporizable material insert 120 configurations in which the vaporizable material 120 forms a sliding fit and/or forms close contact with the vaporizable material insert receptacle 118 can allow for efficient heat transfer between the heating element 141 and the vaporizable material insert 120, thereby causing efficient and effective heating of the vaporizable material 102 of the vaporizable material insert 120.

Furthermore, the vaporizable material insert 120 can include compressed and/or high density configurations of non-liquid vaporizable material 102, which can further contribute to efficient and effective heating and vaporizing of the vaporizable material 102. For example, vaporizable material 102 in a compressed and/or high-density configuration can include a minimal amount of air or pockets of air in the vaporizable material 102 thereby increasing the efficiency and effectiveness of transferring heat along the vaporizable material 102. Such a configuration can allow for reduced power consumption at least because less heating power is needed to effectively heat and vaporize the vaporizable material 102. Additionally, lower heating temperatures can be used to heat the vaporizable material 102 at least because of the improved heating efficiency of the vaporizable material 102, which can also reduce power consumption and formation of hazardous byproducts resulting from heating the vaporizable material at higher temperatures. Various embodiments of the vaporizable material insert 120 are described herein that include the vaporizable material formed in compressed and/or high-density configurations for achieving at least some of the benefits described above.

Figure 2A:
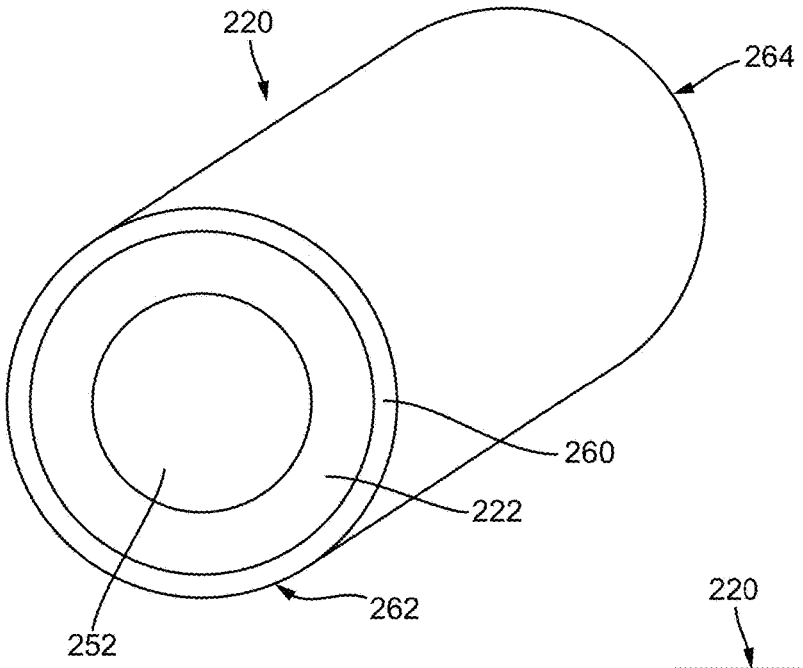
FIG. 2A illustrates a perspective view of an embodiment of a vaporizable material insert that can be used with the vaporizer device of FIG. 1.
Figure 2B:
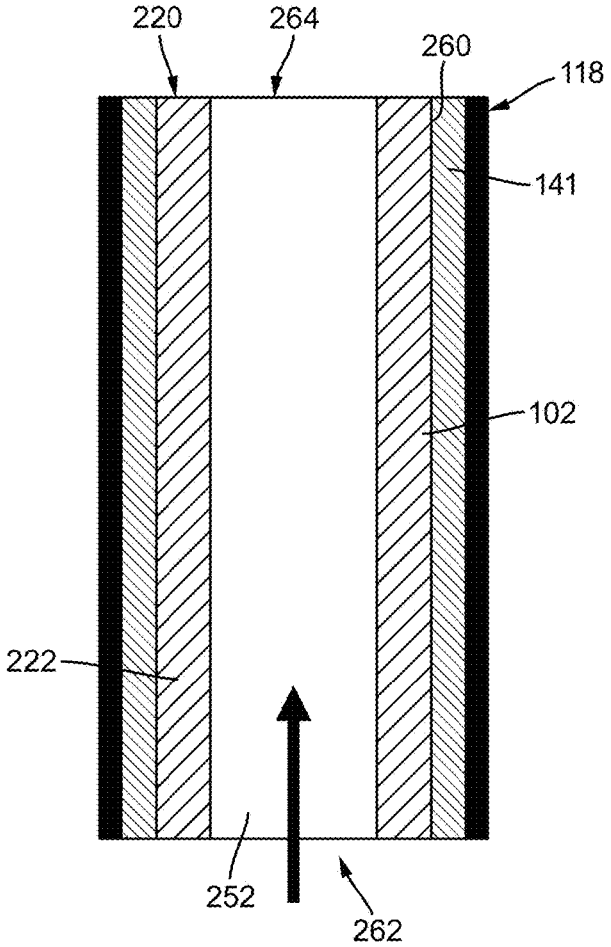
FIG. 2B illustrates a cross-section view of the vaporizable material insert of FIG. 2A inserted in an embodiment of a vaporizable material insert receptacle of the vaporizer device.

FIGS. 2A-2B illustrate an embodiment of a vaporizable material insert 220 that can be inserted in a receptacle of a vaporizer body 110 (e.g., vaporizable material insert receptacle 118 of FIG. 1) for heating and forming an inhalable aerosol. As shown in FIG. 2A, the vaporizable material insert 220 can include a housing 260 having an inner chamber that extends between an inlet 262 and an outlet 264 of the housing 260. The vaporizable material insert 220 can include a vaporizable material component 222 that is at least partly contained in the housing 260 and extends between the inlet 262 and outlet 264. As shown in FIG. 2A, the vaporizable material insert 220 can include an airflow pathway 252 that extends through the vaporizable material component 222, such as along a longitudinal axis of the vaporizable material component 222. As such, an inner wall of the vaporizable material component 222 can define the airflow pathway 252.

As shown in FIG. 2A, the vaporizable material insert 220 can have a cylindrical shape, however, the vaporizable material insert 220 (including the vaporizable material component 222, housing 260, and airflow pathway 252) can include one or more of a variety of shapes and sizes without departing the scope of this disclosure. Additionally, although the vaporizable material insert 220 illustrated in FIG. 2A is described herein as including a housing 260, the vaporizable material insert 220 and any of the vaporizable material inserts described herein may not include a housing 260. For example, an outer wall of the vaporizable material component 222 can form the outer wall of the vaporizable material insert 220. In some embodiments, the housing 260 may assist with containing the vaporizable material component 222 and reduce or prevent contact between the vaporizable material component 222 and the vaporizable material insert receptacle 118, such as to reduce contamination of the vaporizable material insert receptacle 118.

The housing 260 can be made out of a variety of materials, including one or more of a thermally conductive material, an insulative material, a biodegradable material, a vaporizable material, and a non-vaporizable material. For example, in some embodiments the housing 260 can be formed out of a paper or paper-like material.

In some embodiments, the vaporizable material component 222 includes one or more vaporizable materials, such as non-liquid vaporizable materials (e.g., tobacco material, etc.), for vaporizing and forming an inhalable aerosol. The vaporizable material component 222 can be dense and substantially void of air pockets. Additionally, the vaporizable material component 222 can prevent airflow from entering and/or flowing through the vaporizable material component 222. As such, the vaporizable material component 222 can have greater thermal conductivity compared to some currently available vaporizable material inserts and non-liquid vaporizable materials. For example, in some embodiments the thermal conductivity of the vaporizable material component 222 may have a range from approximately 0.05 W/mK to approximately 1 W/mK, such as approximately 0.2 W/mK to approximately 0.6 W/mK.

In some embodiments, the vaporizable material component 222 can include one or more of a guar gum, a laponite, and a powder form of a non-liquid vaporizable material. For example, during manufacturing, the vaporizable material component 222 can be formed in a mold or extruded. For example, the vaporizable material component 222 can be formed by extruding a mixture of tobacco powder and guar gum. In some embodiments, the vaporizable material component 222 can be formed by pressing a tobacco and laponite mixture into a mold. Such vaporizable material component 222 formations can include higher-density and higher thermal conductivity properties compared at least to some non-liquid vaporizable materials and vaporizable material inserts.

In some embodiments, the vaporizable material component 222 can include thermally conductive particles that are included in the vaporizable material mixture during manufacturing and are contained within the vaporizable material component 222. The thermally conductive particles can be in direct contact with the vaporizable material 102 of the vaporizable material component 222, such as to allow for inductive and/or conductive heating of the vaporizable material 102 for forming the inhalable aerosol.

For example, during use of the vaporizable material insert 220, the vaporizable material insert 220 can be inserted in the vaporizable material insert receptacle 118 such that the vaporizable material component 222 is positioned adjacent to and/or in contact with a heating element positioned along the vaporizable material insert receptacle 118. For example, the housing 260 of the vaporizable material insert 220 can be in contact with the heating element 141 and allow heat to be transferred through the housing 260 to heat the vaporizable material component 222. The vaporizable material component 222 can be heated by the heating element to a temperature (e.g., approximately 250 degrees Celsius) that vaporizes at least a part of the vaporizable material 102 contained in the vaporizable material component 222. Vaporization of the vaporizable material 102 can cause formation of the inhalable aerosol in the airflow pathway 252, which can then travel along the airflow pathway 252 for inhalation by a user. As described above, the vaporizable material component 222 can prevent air from entering the vaporizable material component 222 thus increasing thermal conductivity along the vaporizable material component 222 to achieve efficient and effective vaporization of the vaporizable material 102 of the vaporizable material component 222. Such increased thermal conductivity along the vaporizable material component 222 (e.g., compared to some other vaporizable material inserts) can achieve improved heating along the vaporizable material component 222, such as more evenly heat along the vaporizable material component 222 and reduce or eliminate over-heating of the vaporizable material component 222. Such improved heating can reduce waste of the vaporizable material component 222 (e.g., reduce or eliminate parts of the vaporizable material component 222 not being effectively heated), as well as reduce the formation of hazardous by-products (e.g., from over-heating the vaporizable material component 222). Other vaporizable material insert 220 embodiments are within the scope of this disclosure, including additional vaporizable material insert 220 embodiments described below.

In some embodiments, the housing 260 of the vaporizable material insert 220 can include a heating element 141. For example, the heating element 141 can be coupled to the vaporizable material component 222 (e.g., the housing 260 can include or be replaced with the heating element 141). As such the vaporizable material component 222 can be positioned between and in contact with the heating element 141 and the airflow pathway 252. In such an embodiment, the vaporizable material insert 220 can include one or more electrical contacts that mate with corresponding contacts along the vaporizable material insert receptacle 118 to allow power from the power source of the vaporizer body to be provided to the heating element 141 of the vaporizable material insert 220. As such, upon activation of the power source (e.g., the power source 112 of FIG. 1), the heating element 141 can directly heat the vaporizable material component 222 to form the inhalable aerosol in the airflow pathway 252, which can then travel along the airflow pathway 252 for inhalation by a user. The heating element 141 can include any one or more of a variety of features, such as a resistive heating element, thermally conductive material, etc. The heating element 141 can be positioned along one or more surfaces of the vaporizable material component 222 for heating the vaporizable material component 222 and forming the inhalable aerosol.

Figure 3A:
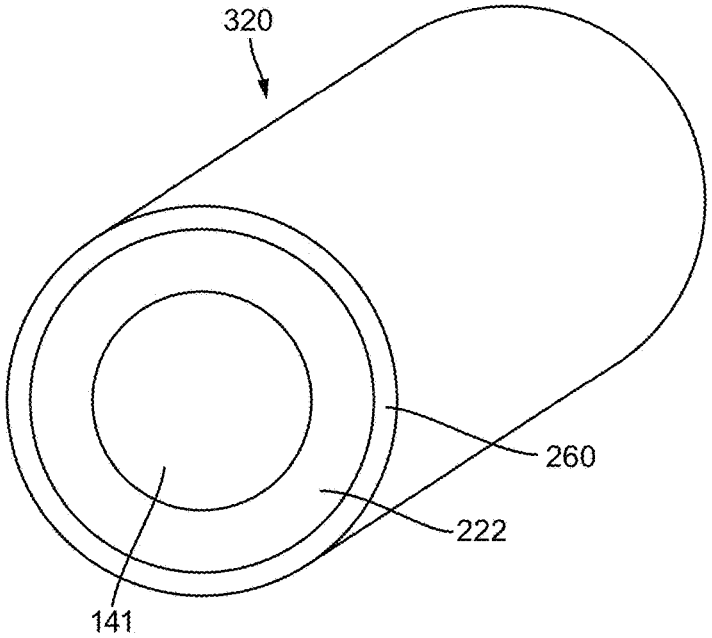
FIG. 3A illustrates a perspective view of another embodiment of a vaporizable material insert that can be used with the vaporizer device of FIG. 1.
Figure 3B:
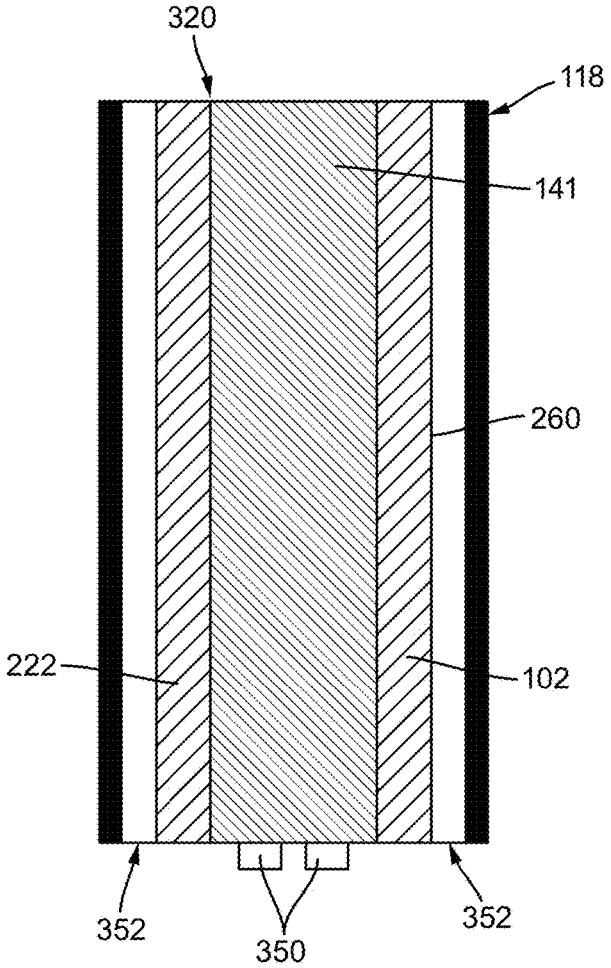
FIG. 3B illustrates a cross-section view of the vaporizable material insert of FIG. 3A inserted in an embodiment of a vaporizable material insert receptacle of the vaporizer device.

FIGS. 3A-3B illustrate another embodiment of the vaporizable material insert 320, including a housing 260, vaporizable material component 222, and a heating element 141. The vaporizable material component 222, housing 260, and heating element 141 of the vaporizable material insert 320 of FIGS. 3A-3B can include any one or more features and functions described above, such as with respect to the vaporizable material insert 220 of FIGS. 2A-2B. As shown in FIG. 3A, the heating element 141 can extend through the vaporizable material component 222 such that the vaporizable material component 222 wraps around the heating element 141. As shown in FIG. 3B, the heating element 141 can include one or more electrical contacts 350 that are configured to mate with corresponding contacts along the vaporizable material insert receptacle 118 to allow power from the power source (e.g., power source 112 of FIG. 1) of the vaporizer body (e.g., vaporizer body 110 of FIG. 1) to be provided to the heating element 141. As such, upon activation of the power source 112, the heating element 141 can directly heat the vaporizable material component 222 to form the inhalable aerosol in the airflow pathway 352, which can then travel along the airflow pathway 352 for inhalation by a user. In such embodiments where the heating element 141 is part of the vaporizable material insert 320, the heating element 141 can be disposed of after use and along with any remaining parts of the vaporizable material insert 320.

As shown in FIG. 3B, the airflow pathway 352 can extend along an outer wall of the vaporizable material component 222, such as between the outer wall of the vaporizable material component 222 and an inner wall of the vaporizable material insert receptacle 118. As such, the airflow pathway 352 can be formed upon insertion of the vaporizable material insert 320 in the vaporizable material insert receptacle 118 and may not extend through the vaporizable material insert 320. In some embodiments and as shown in FIG. 3A, the vaporizable material insert 320 can include a housing 260 that wraps around the outer wall of the vaporizable material component 222. As such, the housing 260 can be formed of a material that allows the vaporized components of the vaporizable material 102 to pass through the housing 260 for allowing the formation of the inhalable aerosol in the airflow pathway 352.

Figure 4A:
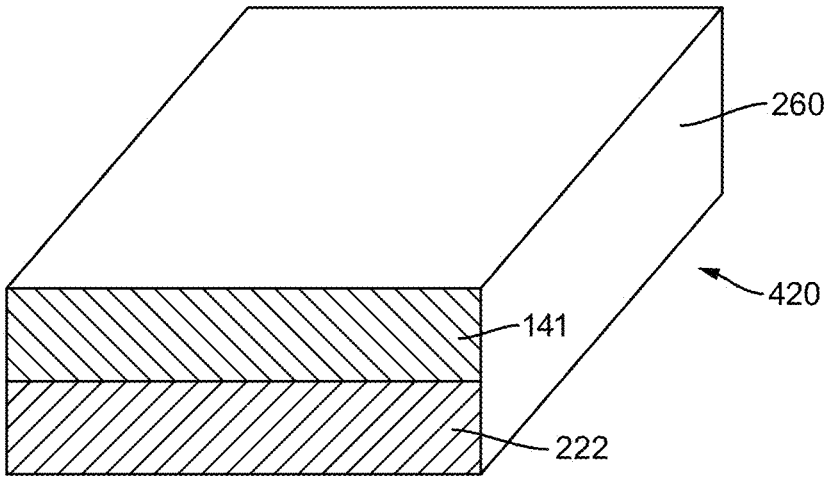
FIG. 4A illustrates a perspective view of yet another embodiment of a vaporizable material insert that can be used with the vaporizer device of FIG. 1.
Figure 4B:
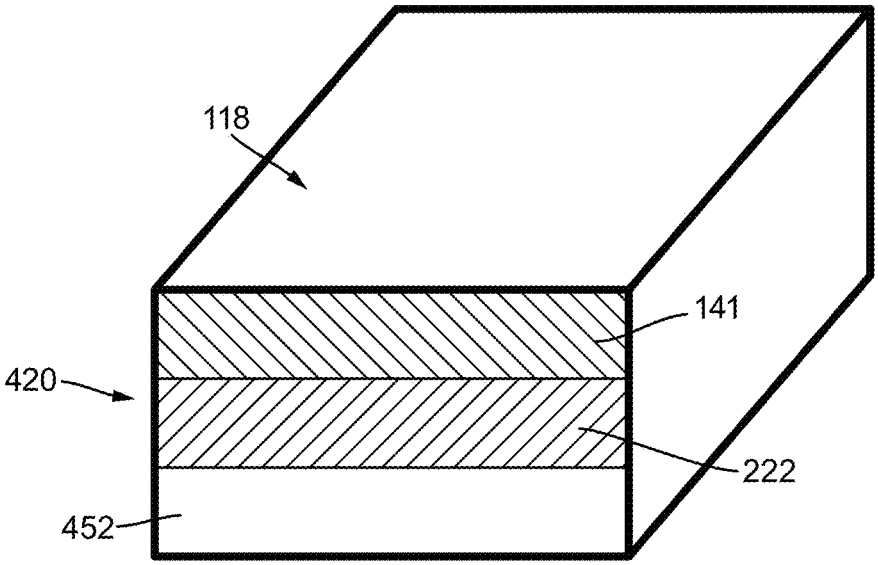
FIG. 4B illustrates a perspective view of the vaporizable material insert of FIG. 4A inserted in an embodiment of a vaporizable material insert receptacle of the vaporizer device.

FIGS. 4A-4B illustrate another embodiment of a vaporizable material insert 420 including a vaporizable material component 222 and a heating element 141. The vaporizable material component 222 and heating element 141 of the vaporizable material insert 420 of FIGS. 4A-4B can include any one or more features and functions described above, such as with respect to the vaporizable material inserts 220, 320 of FIGS. 2A-3B. As shown in FIG. 4A, the vaporizable material component 222 can have a flat configuration with the heating element 141 positioned along a first side of the vaporizable material component 222. The heating element 141 can be in direct contact with the vaporizable material component 222. In some embodiments, the vaporizable material insert 420 can include a housing 260 that extends around one or more parts of the vaporizable material insert 420, such as around the vaporizable material component 222 and/or heating element 141. The heating element 141 can include one or more electrical contacts (e.g., such as the electrical contacts 350 of FIG. 3B) configured to mate with corresponding contacts along the vaporizable material insert receptacle 118 to allow power from the power source of the vaporizer body to be provided to the heating element 141. As such, upon activation of the power source, the heating element 141 can directly heat the vaporizable material component 222 to form the inhalable aerosol in the airflow pathway 352, which can then travel along the airflow pathway 452 for inhalation by a user.

As shown in FIG. 4B, the airflow pathway 452 can extend along a second side of the vaporizable material component 222 (e.g., opposite the first side of the vaporizable material component 222), such as between the second side of the vaporizable material component 222 and an inner wall of the vaporizable material insert receptacle 118. As such, the airflow pathway 352 can be formed upon insertion of the vaporizable material insert 420 in the vaporizable material insert receptacle 118 and may not extend through the vaporizable material insert 420. In such embodiments where the heating element 141 is part of the vaporizable material insert 420, the heating element 141 can be disposed of after use and along with any remaining parts of the vaporizable material insert 420.

Other vaporizable material insert embodiments are within the scope of this disclosure. For example, some embodiments of the vaporizable material insert can include a vaporizable material component including a non-liquid vaporizable material. Furthermore, some vaporizable material inserts can be void of an airflow pathway and a heating element. As such, the vaporizable material insert may only include a vaporizable material component or only a vaporizable material component and a housing. Such embodiments of the vaporizable material insert can rely on the vaporizer to include the heating element and at least part of the airflow pathway for allowing the inhalable aerosol to form for inhalation by a user.

Terminology

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present.

Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments and implementations only and is not intended to be limiting. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on," above and in the claims is intended to mean, "based at least in part on," such that an unrecited feature or element is also permissible.

Spatially relative terms, such as "forward", "rearward", "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings provided herein.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes may be made to various embodiments without departing from the teachings herein. For example, the order in which various described method steps are performed may often be changed in alternative embodiments, and in other alternative embodiments, one or more method steps may be skipped altogether. Optional features of various device and system embodiments may be included in some embodiments and not in others. Therefore, the foregoing description is provided primarily for exemplary purposes and should not be interpreted to limit the scope of the claims.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system may include clients and servers. A client and server are generally remote from each other and typically interact through a communication network. The relationship of client and server arises by virtue of computer programs running on the respective computers and having a client-server relationship to each other.

These computer programs, which can also be referred to programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example, as would a processor cache or other random access memory associated with one or more physical processor cores.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The invention claimed is:

1. A vaporizable material insert for use with a vaporizer device to form an inhalable aerosol, the vaporizable material insert comprising:

a housing including an inlet and an outlet;

a vaporizable material component comprising a vaporizable material for forming a part of the inhalable aerosol as a result of heating the vaporizable material component, the vaporizable material component extending within the housing between the inlet and outlet; and an airflow pathway extending along the vaporizable material component and at least partly defined by a wall of the vaporizable material component, the wall of the vaporizable material component preventing air traveling along the airflow pathway from traveling into the vaporizable material component, the wall allowing the inhalable aerosol to form in the airflow pathway and travel through the outlet for inhalation by a user.

2. The vaporizable material insert of claim 1, wherein the vaporizable material component comprises a cylindrical shape.

3. The vaporizable material insert of claim 1, wherein the airflow pathway extends through the vaporizable material component such that the wall defines the airflow pathway.

4. The vaporizable material insert of claim 1, further comprising a heating element extending along the vaporizable material component, the vaporizable material component being positioned between the heating element and the airflow pathway.

5. The vaporizable material insert of claim 4, wherein the heating element extends through and along a longitudinal axis of the vaporizable material component.

6. The vaporizable material insert of claim 4, wherein the vaporizable material component includes a flat shape.

7. The vaporizable material insert of claim 1, wherein the vaporizable material comprises a tobacco material.

8. The vaporizable material insert of claim 7, wherein the tobacco material comprises a tobacco powder.

9. The vaporizable material insert of claim 1, wherein the housing is formed of a paper material.

10. The vaporizable material insert of claim 1, wherein the housing comprises a heating element configured to heat the vaporizable material component.

11. The vaporizable material insert of claim 1, wherein the vaporizable material component comprises thermally conductive particles that directly contact the vaporizable material and are contained within the vaporizable material component.

12. The vaporizable material insert of claim 11, wherein the thermally conductive particles are formed of a metal material.

13. The vaporizable material insert of claim 1, wherein a thermal conductivity of the vaporizable material component includes a range from approximately 0.2 W/mK to approximately 0.6 W/mK.

14. A system for generating an inhalable aerosol, the system comprising:

a vaporizable material insert, comprising:

a housing including an inlet and an outlet;

a vaporizable material component comprising a vaporizable material for forming a part of the inhalable aerosol as a result of heating the vaporizable material component, the vaporizable material component extending within the housing between the inlet and outlet; and an airflow pathway extending along the vaporizable material component and at least partly defined by a wall of the vaporizable material component, the wall of the vaporizable material component preventing air traveling along the airflow pathway from traveling into the vaporizable material component, the wall allowing the inhalable aerosol to form in the airflow pathway and travel through the outlet for inhalation by a user; and a vaporizer device comprising:

a vaporizable material insert receptacle configured to receive the vaporizable material insert; and a power supply for providing power to a heating element for heating the vaporizable material insert and forming the inhalable aerosol.

15. The system of claim 14, wherein the vaporizer device comprises the heating element.

16. The system of claim 14, wherein the vaporizable material insert comprises the heating element.

17. The system of claim 14, wherein the vaporizable material insert receptacle provides a sliding fit with the vaporizable material insert.

18. The system of claim 14, wherein the vaporizable material comprises a tobacco material.

19. The system of claim 18, wherein the tobacco material comprises a tobacco powder.

20. A method for generating an inhalable aerosol for inhalation by a user, the method comprising:

receiving a vaporizable material insert into a compartment of a vaporizer device, the vaporizable material insert comprising:

a housing including an inlet and an outlet;

a vaporizable material component comprising a vaporizable material for forming a part of the inhalable aerosol as a result of heating the vaporizable material component, the vaporizable material component extending within the housing between the inlet and outlet; and an airflow pathway extending along the vaporizable material component and at least partly defined by a wall of the vaporizable material component, the wall of the vaporizable material component preventing air traveling along the airflow pathway from traveling into the vaporizable material component, the wall allowing the inhalable aerosol to form in the airflow pathway and travel through the outlet for inhalation by a user; and activating a heating element configured to heat the vaporizable material component of the vaporizable material insert; and forming, as a result of the heated vaporizable material component, the inhalable aerosol.

* * * * *